US006863431B2

(12) United States Patent
Yacko et al.

(10) Patent No.: US 6,863,431 B2
(45) Date of Patent: Mar. 8, 2005

(54) DISRUPTOR DEVICE WHICH ELIMINATES CROSS CONTAMINATION

(75) Inventors: Richard M. Yacko, Monroe, CT (US); Jeffrey Myer, Bethlehem, CT (US); Roy R. Blair, Waterbury, CT (US)

(73) Assignee: Omni International, Inc., Marietta, GA (US)

( * ) Notice: Subject to any disclaimer, the term of this patent is extended or adjusted under 35 U.S.C. 154(b) by 0 days.

(21) Appl. No.: 10/455,200

(22) Filed: Jun. 5, 2003

(65) Prior Publication Data

US 2003/0206485 A1 Nov. 6, 2003

Related U.S. Application Data

(63) Continuation of application No. 07/859,844, filed on Mar. 30, 1992, now abandoned.

(51) Int. Cl.[7] ..... B02C 18/10; B02C 13/18; B01F 7/00

(52) U.S. Cl. ..... 366/129; 366/279; 366/343; 366/264; 241/46.06; 241/188.1; 241/258

(58) Field of Search ..... 366/279, 262, 366/263, 129, 143, 265, 270, 176, 343, 264; 214/2, 46.08; 241/46.11, 46.06, 188.2, 258, 246, 188.1; 422/61, 99

(56) References Cited

U.S. PATENT DOCUMENTS

| | | | | | |
|---|---|---|---|---|---|
| 1,691,200 | A | * | 11/1928 | Krug | 464/177 |
| 2,541,221 | A | | 2/1951 | Edwards | |
| 2,789,800 | A | | 4/1957 | Willems | |
| 2,985,389 | A | | 5/1961 | Willems | |
| 3,136,660 | A | | 6/1964 | Mueller | |
| 3,251,580 | A | | 5/1966 | Adams | |
| 3,299,924 | A | | 1/1967 | Hanschitz | |
| 3,333,830 | A | | 8/1967 | Spingler et al. | |
| 3,666,187 | A | * | 5/1972 | Norris | 241/46.01 |
| 3,724,765 | A | | 4/1973 | Rohrbaugh et al. | |
| 3,912,236 | A | | 10/1975 | Zipperer et al. | |
| 4,307,846 | A | | 12/1981 | Spelsberg | |
| 4,405,998 | A | | 9/1983 | Brison | |
| 4,530,606 | A | | 7/1985 | Hopkins et al. | |
| 4,738,543 | A | * | 4/1988 | Seeger | 366/307 |
| 4,745,068 | A | * | 5/1988 | Godfrey et al. | 366/266 |
| 4,850,699 | A | | 7/1989 | Rebordosa | |
| 4,974,965 | A | | 12/1990 | Heinhold et al. | |
| 5,316,382 | A | | 5/1994 | Penaranda et al. | |
| 5,478,150 | A | * | 12/1995 | Keller et al. | 366/336 |
| 6,398,402 | B1 | | 6/2002 | Thomas et al. | |

* cited by examiner

*Primary Examiner*—Tony G. Soohoo
(74) *Attorney, Agent, or Firm*—Gardner Groff, P.C.

(57) ABSTRACT

A plastic disruption and homogenization device. The device has rotor that is axially disposed within a stator. The stator and the rotor have several teeth to aid the disruption and homogenization process. The device consists of plastic material that allows the rotor to rotate smoothly without the use of bearings.

13 Claims, 1 Drawing Sheet

DISRUPTOR DEVICE WHICH ELIMINATES CROSS CONTAMINATION

CROSS-REFERENCE TO RELATED APPLICATION

This application is a continuation of U.S. patent application Ser. No. 07/859,844 filed Mar. 30, 1992 now abandoned, the entirety of which is hereby incorporated herein by reference for all purposes.

BACKGROUND OF THE INVENTION

1. Field of the Invention

The present invention relates generally to the field of homogenizing devices for liquid substrates, and more particularly, to a single-use, two-part agitation device.

2. Description of Related Art

When compared with previous years, modern laboratory assays require relatively small quantities of sample to obtain accurate results. When utilizing a reduced quantity of sample, however, the importance of obtaining complete homogenization without the introduction of contaminants is increased to maintain accuracy of the sample reading. Preventing the introduction of contaminants with the disrupter device is crucial when working with contaminant-sensitive samples, such as DNA or RNA. Additionally, agitation of such minute quantities must be performed without damaging the device, the sample housing, or spillage of the sample.

Conventional laboratory mixers are well known in the art. Generally, these devices possess an outer shaft (stator), and a central inner shaft (rotor), each having disruptor teeth at the lower end. Ball bearings or other types of bearings are generally provided between the rotor and stator, allowing the rotor to rotate while allowing the outer stator to remain fixed in position. Activation of the rotor draws the liquid substrate upwards to the rotor and outwardly towards the teeth of the stator, subjecting the liquid to the shearing action of the teeth. Variations in the size and shape of the teeth may affect the homogenization of the substrate.

Past devices have generally incorporated an ultrasonic pressure field to increase the agitation of solid particulates and increase homogeneity of the sample. Usually, the rotor is activated to turn at a determined velocity, resulting in the ultrasonic pressure field. The pressure field disintegrates solid particulates in the liquid, causing a homogenized sample for analysis.

Since modem high-speed analysis requires numerous samples to be homogenized in a relatively short amount of time, decontamination of the disruptor device following each use becomes impractical. The increased surface area of the teeth and the channels formed by the interacting teeth increase the difficulty of ensuring decontamination of the device. Additionally, due to the increased economic costs of properly assembling and aligning the mixing teeth, ball bearings, stator, and rotor, applying such mixers to single-use applications is not feasible for many researchers in the biological sciences.

Thus, it has been found that needs exist for an improved disrupter device to adequately homogenize a sample while minimizing or eliminating the introduction of contaminants. Needs further exist for a simple and economically feasible disposable disruptor device. It is to these and other needs that the present invention is primarily directed.

SUMMARY OF THE INVENTION

Briefly described, in its preferred embodiments, the present invention relates generally to an improved disrupter device. In example embodiments, the disrupter device of the present invention achieves complete homogenization of the sample without introducing contaminants. In addition, example embodiments of the device utilize a low-cost, two-piece design for economical single-use application.

In one aspect, the present invention is a plastic single-use disruptor device. The device preferably includes a rotor having a first end and a second end. The first end of the rotor includes several spaced teeth. The second end of the rotor comprises a releasable coupling for attachment to a rotating mechanism. The disruptor device also includes a hollow stator having a first end and a second end. The stator cylindrically houses the rotor. The first end of the stator includes several spaced teeth adjacent to the teeth on the first end of the stator, when assembled. The rotor rests within the stator and freely rotates without need of any bearings or other interposed components. Because the device is plastic and consists of only two parts, it is readily sterilized, but also economically feasible for single-use disposability.

In another aspect, the invention is an adapter for coupling a disrupter device to a rotational drive means. The adaptor preferably has a substantially hollow bore, which receives the stator through the use of locking pins. The hollow bore further preferably includes compression springs and a compression spring washer that receive the stator.

In yet another aspect, the invention is a disrupter device comprising a stator having a first end and a second end. The first end preferably includes at least one tooth, and the stator preferably defines a bore extending axially therethrough. The bore is preferably stepped to form a bearing surface facing the second end of the stator. The rotor preferably has a first end and a second end, with the first end of the rotor preferably comprising at least one tooth. The rotor preferably further comprises a flange having an expanded dimension, wherein the rotor is rotationally mounted within the bore of the stator with the flange of the rotor directly contacting the bearing surface of the stator without any interposed components.

In yet another aspect, the invention is a disruptor device comprising a stator having a first end and a second end. A bore preferably extends through the stator from the first end to the second end, and the second end preferably comprises at least one slot. The rotor is preferably rotationally mounted within the bore of the stator without any bearing components interposed between the rotor and the stator. The device preferably further includes adaptor coupling with a bore extending therethrough and at least one locking pin for engagement with the slot in the second end of the stator.

These and other features and advantages of representative embodiments of the present invention are described herein with reference to the drawing figures.

BRIEF DESCRIPTION OF THE DRAWING FIGURES

DETAILED DESCRIPTION

Figure 1:
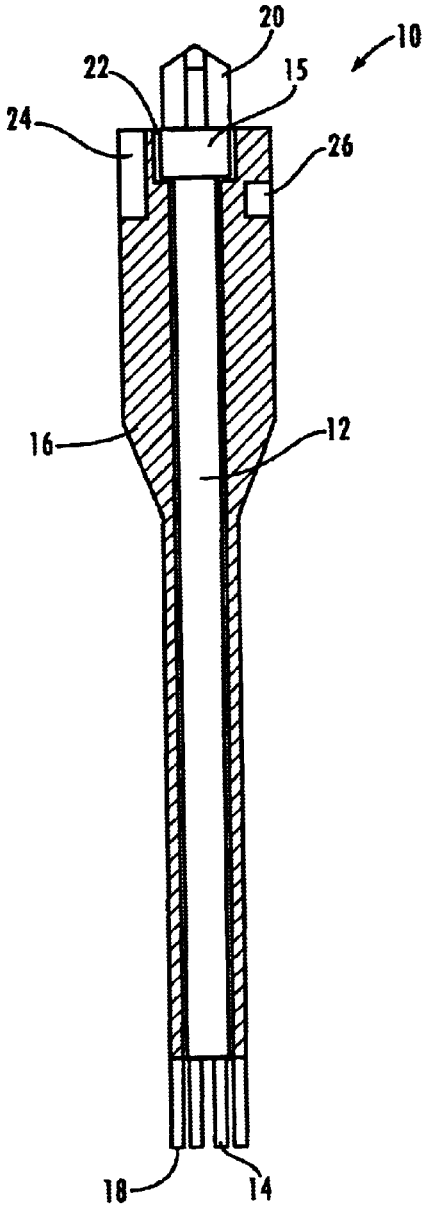
FIG. 1 shows a disruptor device according to an example embodiment of the present invention, in partial cross-section to show the rotor.

Referring now to the drawing figures, in which like reference numbers refer to like parts throughout, preferred forms of the present invention will now be described by way of example embodiments. It is to be understood that the embodiments described and depicted herein are only selected examples of the many and various forms that the present invention may take, and that these examples are not intended to be exhaustive or limiting of the claimed invention. Also, as used in the specification including the appended claims, the singular forms "a," "an," and "the" include the plural unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With particular reference now to FIG. 1, a disruptor device 10 according to an example embodiment of the present invention includes a rotor 12 preferably formed substantially of engineering plastics such as for example polyetherimide (for example, Ultem® polyetherimide, commercially available from TexLoc, Ltd. Manufacturing, Forth Worth, Tex.), or polycarbonate (for example, LEXAN® polycarbonate, commercially available from Polymer Plastics. Mountain View, Calif.). The rotor 12 consists of a first end and a second end. The first end of the rotor 12 preferably comprises a plurality of spaced teeth 14. The second end of the rotor 12 preferably includes a flange 15 having an increased diameter relative to the body of the rotor. The second end of the rotor 12 preferably further comprises at least one fin 20 for engagement with an adaptor or drive means. The drive means can be, for example, a motor drive, forced compressed air, vacuum, a mechanized crank, or adaptors for use thereof.

The disruptor device 10 further comprises a stator 16, which preferably is a hollow, generally cylindrical tube formed substantially of plastic (such as for example polyetherimide or polycarbonate), having a first end and second end. The first end of the stator 16 preferably comprises a plurality of teeth 18 located adjacent to the teeth 14 on the first end of the rotor 12 when the device is assembled. The second end of the stator 16 preferably defines a bore 22 having a larger diameter than the lumen extending through the hollow stator, the bore 22 being configured to receive the flange 15 of the second end of the rotor 12, whereby upon assembly, the rotor 12 is held within stator 16 to permit rotation of rotor 12.

The shaft of the rotor 12 is received within the lumen extending through the stator 16 until the flange 15 of the rotor abuts against the lower surface of the bore 22 in the stator 16. Engagement of the flange 15 against the lower surface of the bore 22 in the stator 16 places the teeth 14 of the rotor 12 in substantial alignment with the teeth 18 of the stator 16. The rotor 12 simply rests within the stator 16, to permit free rotation of the rotor within the stator without the need for a separate bearing or other component(s) interposed therebetween. In this manner, a simple, inexpensive, two-piece assembly is provided, thereby enabling economically feasible single-use disposability. The stator 16 is preferably fabricated from a clear material such as polycarbonate, so that its interior is visible during use and cleaning, if desired. The rotor 12 is preferably fabricated from an opaque material such as polyetherimide, so that it may be observed through the clear material of the stator 16. The use of these materials is further advantageous, as the polycarbonate provides a smooth, low-friction finished surface, and the polyetherimide provides lubricity, to enable smooth, low-friction, high-speed rotation of the rotor relative to the stator without the need for a separate bearing or other interposed components. The device 10 is preferably sterilized and packaged to retain sterility during shipping and until the device is ready to be used.

Figure 2:
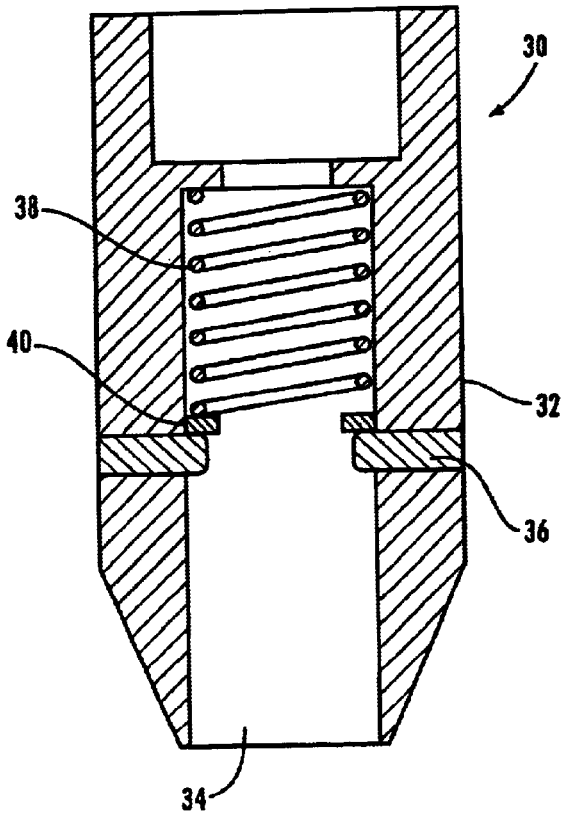
FIG. 2 is a cross-sectional view of an adapter for coupling a disruptor device to a drive means, according to an example embodiment of the present invention.

With reference now to FIG. 2, a coupling adapter 30 according to an example embodiment of the present invention is shown. The coupling 30 preferably comprises a body or housing 32 having a cylindrical bore or recess 34 extending therethrough. The bore 34 preferably comprises at least one locking pin 36 to engage the disrupter device 10 when inserted. The adaptor 30 preferably further comprises a compression spring 38 and a retaining washer 40 mounted in the bore 34. The upper end of the rotor-stator assembly 10 can be inserted into the bore 34 of the coupling adaptor 30, whereupon vertical portions of channels or slots 24 formed in the upper end of the stator 16 receive and engage the locking pins 36. The top of the stator 16 contacts the spring retaining washer 40 and compresses the spring 38 as the rotor-stator assembly 10 is inserted into the coupling adaptor 30. This compression causes a downward force to be applied by the spring 38 and washer 40 against the rotor-stator assembly 10. When the rotor-stator assembly 10 is inserted far enough into the bore 34 of the coupling adaptor 30, the locking pins 36 come into alignment with horizontal portions of the channels or slots 26 formed in the upper end of the stator 16. The stator 16 can then be rotated, for example through about 90°, to a final position wherein downward pressure applied by the spring 38 engages the locking pins 36 with radiused detents in the stator channels or slots to lock the coupling adaptor to the stator, and lock the stator in position in the adaptor to resist relative rotation therebetween. This quarter-turn adaptor 30 enables the device 10 to be quickly and easily installed and removed from a drive mechanism without the risk of cross-threading the plastic material of the device 10, as might occur if conventional screw-thread connection means were utilized. The adaptor also facilitates connecting the device 10 to a multiplicity of drive means, such as drive motors of various manufacturers, thereby making the device 10 suitable for economical use by a broad range of practitioners without the need for purchasing additional or specialized homogenizing equipment.

While the invention has been described in its preferred forms, it will be readily apparent to those of ordinary skill in the art that many additions, modifications and deletions can be made thereto without departing from the spirit and scope of the invention.

What is claimed is:

1. A disposable disruptor attachment for use with a reusable drive means, consisting of:

a rotor, said rotor substantially composed of plastic, said rotor consisting of an elongate body consisting of a flange, a first end having a plurality of spaced teeth, and a second end having a coupling for removable attachment to said drive means; and a stator, said stator substantially composed of plastic, said stator consisting of a cylindrical hollow body defining a bore extending axially therethrough in which the rotor is axially housed, a first end having a plurality of spaced teeth, and a second end, the bore stepped to form a bearing surface facing the second end of the stator, wherein said rotor is received within the bore of said stator with the flange of said rotor directly contacting, supported by, frictionally rotational on the bearing surface of said stator without any interposed components, wherein placement of the rotor within the stator positions the teeth of the stator adjacent to the teeth of the second end of the rotor.

2. The disposable disrupter attachment of claim 1, wherein said stator is composed of a substantially transparent plastic.

3. The disposable disrupter attachment of claim 1, wherein the second end of the stator couples to an adapter having a bore through which the first end of the rotor extends.

4. The disposable disruptor attachment of claim 1 in combination with a reusable adapter, wherein the adapter has a bore extending therethrough that receives and removably couples to the second end of the stator and that rotationally receives the rotor so that the rotor extends all the way through the bore and the first end of the rotor extends out off the adapter for removable attachment to the drive means.

5. The combination disposable disruptor attachment and reusable adapter of claim 4, wherein the adapter has at least one locking Din extending inwardly within the bore and the second end of the stator has at least one slot that receives the at least one locking pin for coupling the stator to the adapter.

6. The disposable disrupter attachment of claim 1, wherein the rotor simply rests within the stator to permit free rotation of the rotor within the stator without a separate bearing component interposed therebetween, wherein the rotor and stator cooperate to form a simple, inexpensive, two-piece assembly that can be economically used as a single-use disposable device to eliminate cross-contamination between samples.

7. A disposable disrupter attachment for use with a reusable drive means, comprising:

a stator having a first end and a second end, said first end comprising at least one tooth, said stator defining a bore extending axially therethrough, said bore being stepped to form a bearing surface facing the second end of the stator; and a rotor having a first end and a second end, the first end of said rotor comprising at least one tooth, the a second end of said rotor having a coupling for removable attachment to said drive means, said rotor further comprising a flange having an expanded dimension, wherein said rotor is received within the bore of said stator with the flange of said rotor directly contacting, supported by, frictionally rotational on the bearing surface of said stator without any interposed components.

8. The disposable disruptor attachment of claim 7, wherein said stator is generally transparent.

9. The disposable disrupter attachment of claim 7, wherein the second end of the stator couples to an adapter having a bore through which the first end of the rotor extends.

10. The disposable disruptor attachment of claim 7 in combination with a reusable adapter, wherein the adapter has a bore extending therethrough that receives and removably couples to the second end of the stator and that rotationally receives the rotor so that the rotor extends all the way through the bore and the first end of the rotor extends out off the adapter for removable attachment to the drive means.

11. The combination disposable disruptor attachment and reusable adapter of claim 10, wherein the adapter has at least one locking pin extending inwardly within the bore and the second end of the stator has at least one slot that receives the at least one locking pin for coupling the stator to the adapter.

12. The disposable disruptor attachment of claim 7, wherein the rotor simply rests within the stator to permit free rotation of the rotor within the stator without a separate bearing component interposed therebetween, wherein the rotor and stator cooperate to form a simple, inexpensive, two-piece assembly that can be economically used as a single-use disposable device to eliminate cross-contamination between samples.

13. A disruptor device for use with a reusable drive means, comprising:

a disposable stator having a first end and a second end and a bore extending therethrough from the first end to the second end, and said second end comprising at least one slot;

a disposable rotor rotationally mounted within the bore of said stator without any bearing components interposed between the rotor and the stator, said rotor having a first end and a second end, the second end having a coupling for removable attachment to said drive means; and a reusable adaptor coupling having a bore extending therethrough and at least one locking pin for engagement with the slot in the second end of the stator.

* * * * *